US008336561B2

(12) United States Patent
You

(10) Patent No.: US 8,336,561 B2
(45) Date of Patent: Dec. 25, 2012

(54) HAIRDRESSING DEVICE

(75) Inventor: Seung An You, Seoul (KR)

(73) Assignee: SM Ceramic Co., Ltd., Seoul (KR)

( * ) Notice: Subject to any disclaimer, the term of this patent is extended or adjusted under 35 U.S.C. 154(b) by 183 days.

(21) Appl. No.: 12/817,129

(22) Filed: Jun. 16, 2010

(65) Prior Publication Data

US 2011/0120491 A1 May 26, 2011

(30) Foreign Application Priority Data

Nov. 26, 2009 (KR) ..... 10-2009-0115351

(51) Int. Cl.
*A45D 2/40* (2006.01)
*A45D 1/04* (2006.01)

(52) U.S. Cl. ..... 132/224; 219/225

(58) Field of Classification Search ..... 132/224, 132/225; 219/225, 229
See application file for complete search history.

(56) References Cited

U.S. PATENT DOCUMENTS 4,910,382 A * 3/1990 Kakuya et al. ..... 219/222
7,989,734 B2 * 8/2011 Lee ..... 219/222
2009/0260650 A1 * 10/2009 Jung ..... 132/224

* cited by examiner

*Primary Examiner* — Robyn Doan
(74) *Attorney, Agent, or Firm* — Patent Law Group LLP; David C. Hsia

(57) ABSTRACT

A hairdressing device includes a pair of arm members opposed to each other and hingedly connected at one longitudinal ends thereof, each of the arm members including a hinge portion, a grip portion contiguous to the hinge portion and a hair-pinching portion contiguous to the grip portion; and a heater member arranged in the hair-pinching portion of each of the arm members to generate heat when supplied with electric power. The heater member includes a pair of heating plates arranged side by side in a spaced-apart relationship with each other. The heater member includes a heat-resistant transparent member arranged between the heating plates to transmit infrared rays.

3 Claims, 6 Drawing Sheets

HAIRDRESSING DEVICE

FIELD OF THE INVENTION

The present invention relates to a hairdressing device and, more particularly, to hairdressing device in which a heat-resistant transparent member is arranged between the heating plates of heater members to prevent the inflow of water vapor and expand the transmission range of infrared rays, thereby preventing damage of the hair and prolonging the lifespan of the hairdressing device.

BACKGROUND OF THE INVENTION

Typically, a hairdressing device is used to produce various kinds of hair styles with an electric heater. The hairdressing device is capable of performing a straight permanent by which curly hair or artificially curled hair is turned to straight one or a wave permanent by which straight hair is turned to curled hair.

Referring to FIG. 1, there is shown a conventional hairdressing device 1 for use in a straight permanent. As shown, the hairdressing device 1 includes a pair of arm members 12 each having a hinge portion 6, a grip portion 8 and a hair-pinching portion 10. The hinge portions 6 of the arm members 12 are joined by a hinge pin 4.

Just like typical clamps, the arm members 12 can be swung about the hinge pin 4 away from or toward each other. A biasing member is retained between the hinge portions 6 to resiliently bias the arm members 12 away from each other. This enables a user to hold the hair with the hairdressing device.

The grip portions 8 of the arm members 12 are contiguous to the hinge portions 6 and are designed to be gripped by a user with ease during the course of performing a permanent. A digital display unit 14 for indicating information such as a heating temperature and a permanent completion time is arranged in one of the grip portions 8. Also arranged in one of the grip portions 8 is a power button 16 for, when actuated, allowing electric power to be applied to the hairdressing device.

The hair-pinching portions 10 of the arm members 12 are contiguous to the grip portions 8 and are designed to pinch the hair therebetween. The hair-pinching portions 10 are provided with heater members 18 facing to each other.

As shown in FIGS. 2 and 3, each of the heater members 18 includes a pair of heating plates H attached to the corresponding one of the hair-pinching portions 10. The heating plates H are arranged side by side in a spaced-apart relationship with each other.

A metallic support member 22 having a plurality of far infrared emission holes 20 is provided between the heating plates H. Each of the heating plates H has a slide groove 19 into which the support member 22 is slidingly fitted. Far infrared rays are emitted through the far infrared emission holes 20 of the support member 22. On the opposite side surfaces of the support member 22, there are formed protrusion portions 32 that can be slidingly fitted to the slide grooves of the heating plates H.

A far infrared generator R for generating far infrared rays in response to an electric signal supplied from a control unit is arranged within one of the hair-pinching portions 10.

With the hairdressing device 1 set forth above, water vapor is generated as the heater members 18 are pulled down along the hair wet with a chemical solution. The water vapor is mostly diffused into the air but partly fed to one of the hair-pinching portions 10 through the far infrared emission holes 20 of the support member 22.

Since the water vapor thus fed stays long in the hair-pinching portions 10, it may cause trouble or malfunction to the component parts of the hairdressing device, which leads to a shortened lifespan of the hairdressing device.

Inasmuch as the support member 22 is made of a metallic material, the far infrared rays cannot pass through the support member 22 and are emitted only through the far infrared emission holes 20. This makes it difficult to diffuse the far infrared rays over the wide area of the hair.

Moreover, the necessity of forming the far infrared emission holes 20 in the metallic support member 22 results in increased production cost.

SUMMARY OF THE INVENTION

In view of the problems inherent in the prior art, it is an object of the present invention to provide a hairdressing device capable of enabling infrared rays to be fed to the hair with ease.

Another object of the present invention is to provide a hairdressing device capable of eliminating the need to form functional holes and consequently reducing the production cost.

A further object of the present invention is to provide a hairdressing device capable of preventing water vapor from being fed to hair-pinching portions, thereby enhancing the durability of the hairdressing device.

A still further object of the present invention is to provide a hairdressing device capable of expanding the infrared transmission area and eventually preventing damage of the hair.

With the above objects in view, the present invention provides a hairdressing device including:

a pair of arm members opposed to each other and hingedly connected at one longitudinal ends thereof, each of the arm members including a hinge portion, a grip portion contiguous to the hinge portion and a hair-pinching portion contiguous to the grip portion; and a heater member arranged in the hair-pinching portion of each of the arm members to generate heat when supplied with electric power, the heater member including a pair of heating plates arranged side by side in a spaced-apart relationship with each other, wherein the heater member includes a heat-resistant transparent member arranged between the heating plates to transmit infrared rays.

In the hairdressing device, each of the heating plates has a slide groove formed on one side surface thereof. The heat-resistant transparent member has a light transmission portion through which infrared rays can pass and protrusion portions formed on the opposite side surfaces of the light transmission portion. The protrusion portions are slidingly fitted to the slide grooves of the heating plates.

In the hairdressing device, the heat-resistant transparent member is made of monocrystalline heat-resistant glass that can bear the heat of about 1000° C.

With the hairdressing device of the present invention, the heat-resistant transparent member is provided between the heating plates of the heater members. This helps facilitate emission of infrared rays. Since the infrared rays are emitted through the entire exposed surface of the heat-resistant transparent member, it becomes possible to facilitate emission of the infrared rays. Omission of the far infrared emission holes required in the prior art hairdressing device makes it possible to save the production cost. The water vapor generated in the course of performing a permanent is prevented from staying long in the hairdressing device, which assists in preventing occurrence of trouble or malfunction in the hairdressing device.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

Figure 1:
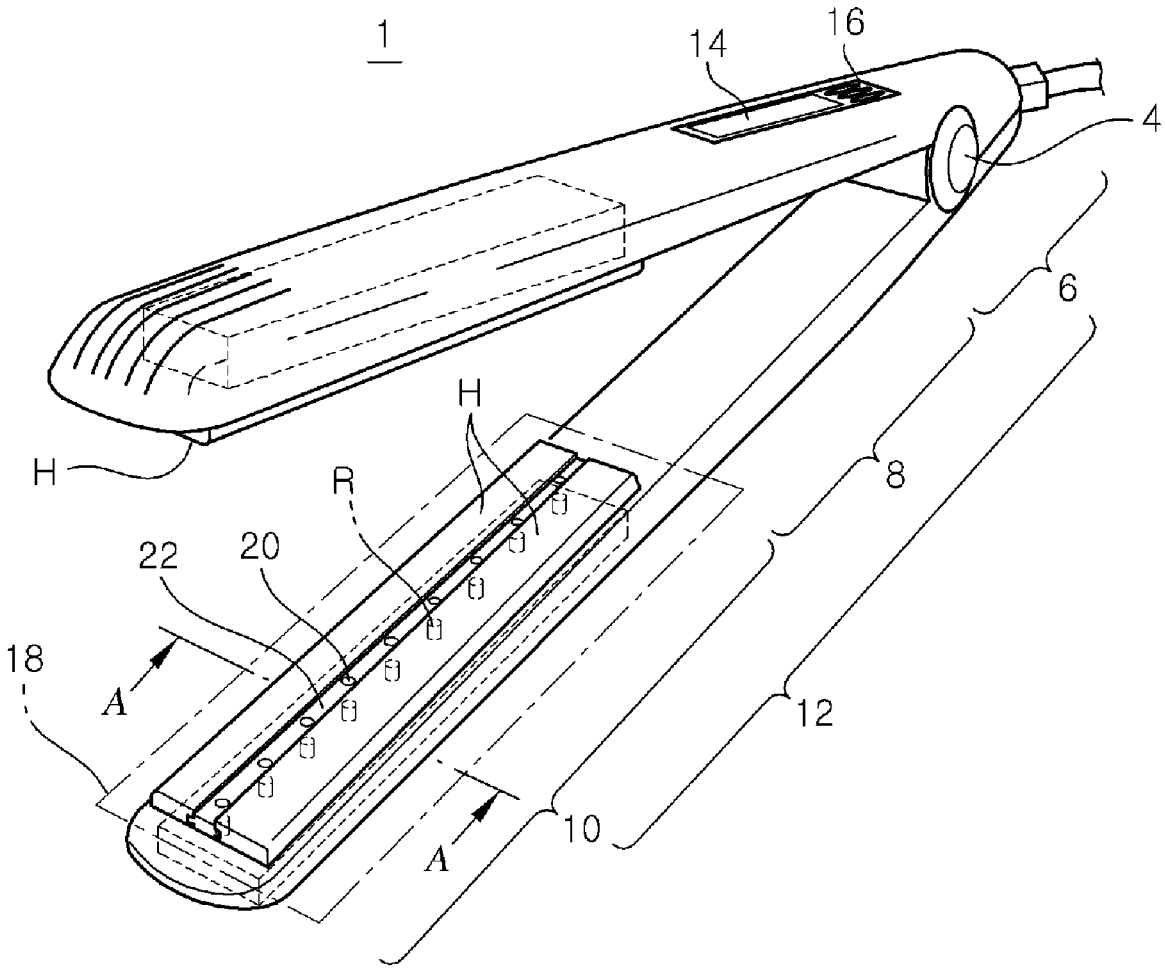
Fig. 1 (Prior Art)
FIG. 1 is a perspective view illustrating a conventional hairdressing device.
Figure 2:
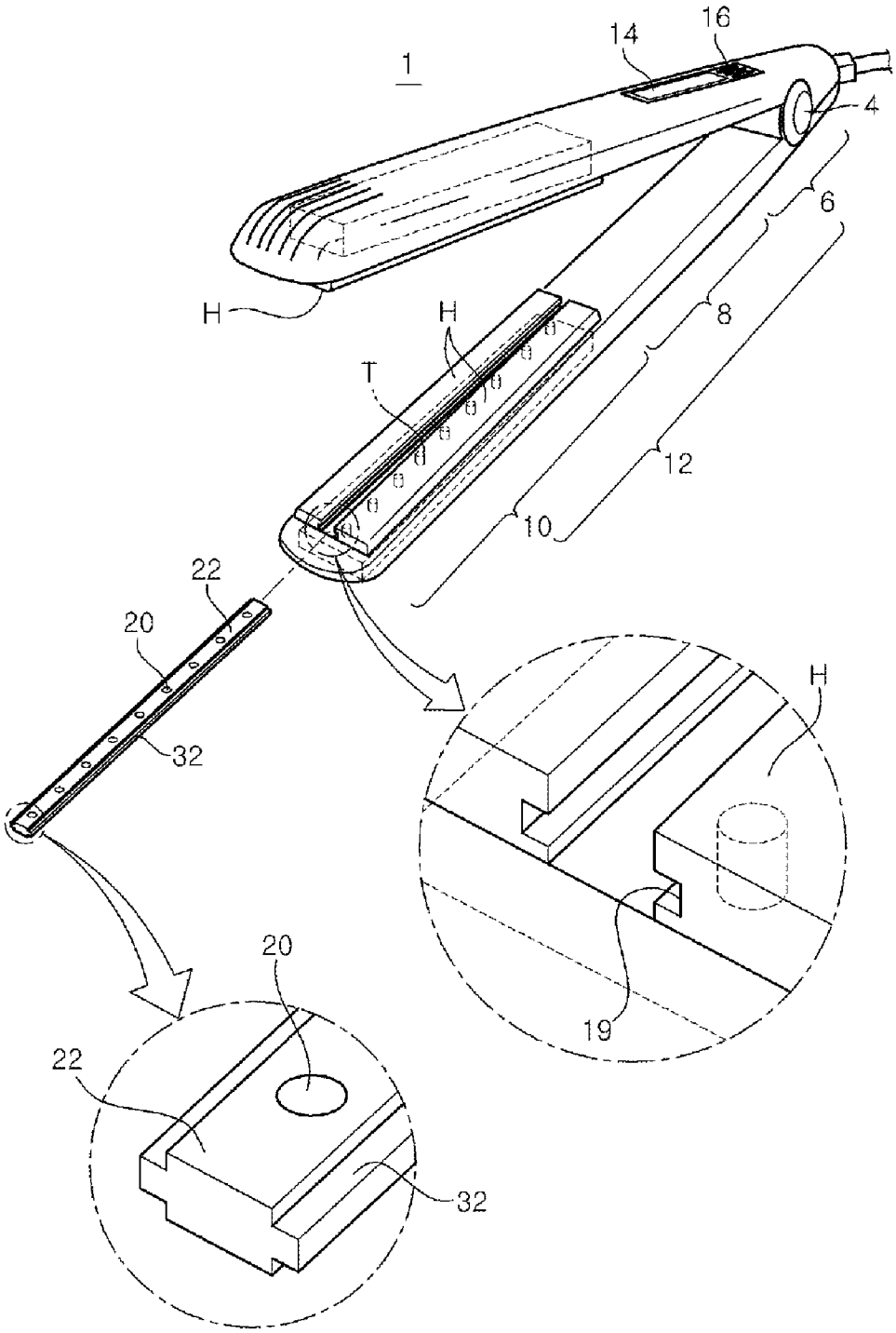
Fig. 2 (Prior Art)
FIG. 2 is an exploded perspective view of the conventional hairdressing device illustrated in FIG. 1.
Figure 3:
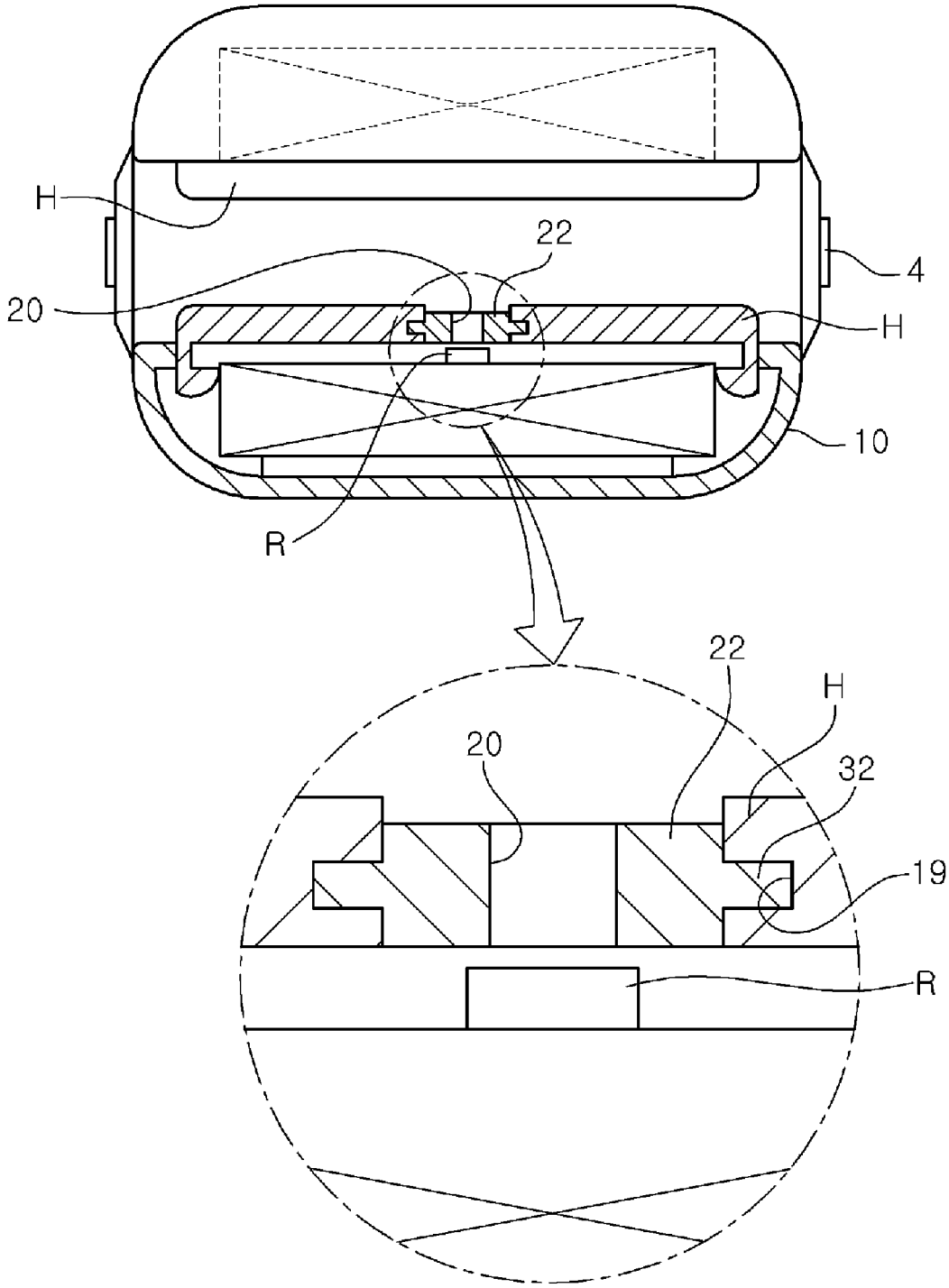
Fig. 3 (Prior Art)
FIG. 3 is a section view taken along line A-A in FIG. 1, illustrating the internal structure of the conventional hairdressing device.

One preferred embodiment of the present invention will now be described in detail with reference to the accompanying drawings. The same reference numerals as used in describing the prior art will be used to designate the same elements.

Figure 4:
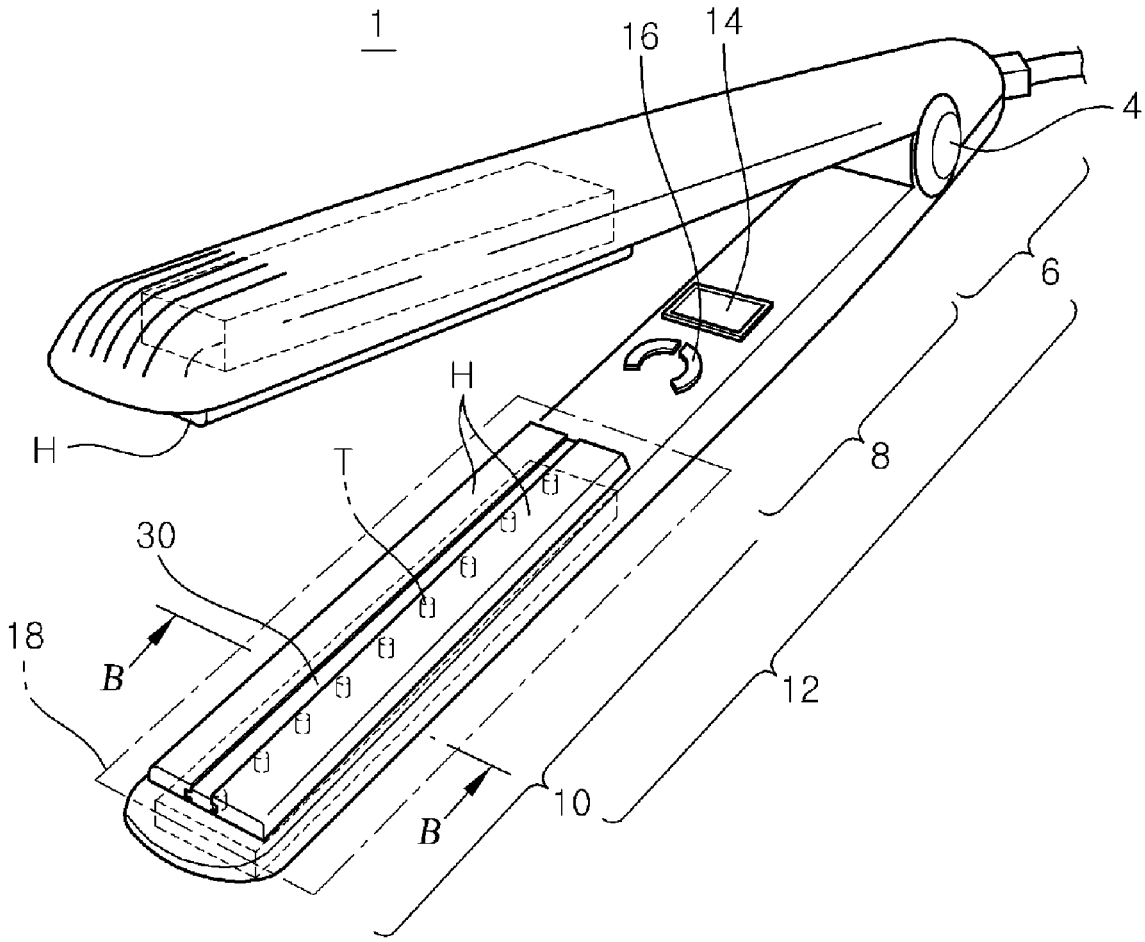
FIG. 4 is a perspective view showing a hairdressing device in accordance with one embodiment of the present invention.
Figure 5:
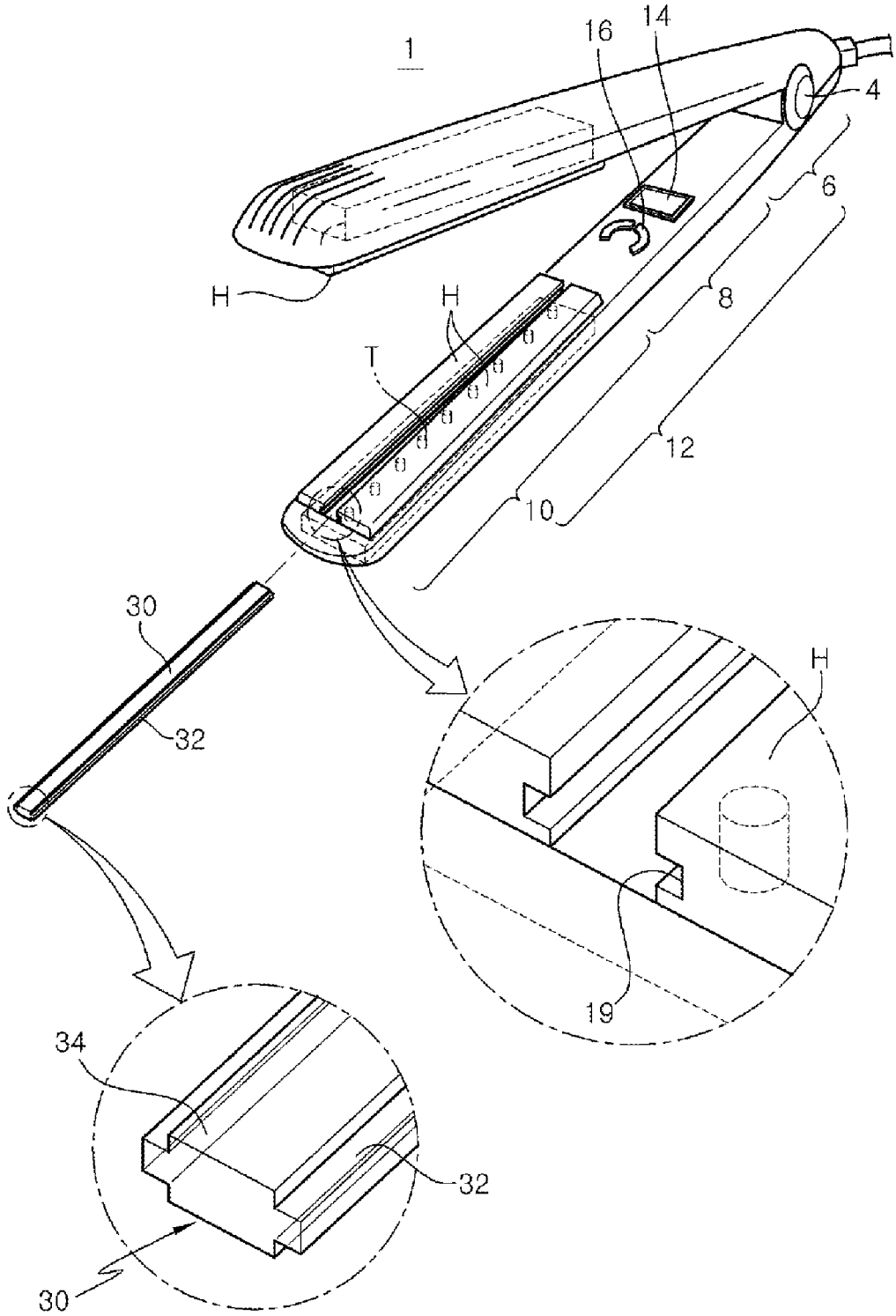
FIG. 5 is an exploded perspective view of the present hairdressing device shown in FIG. 4.
Figure 6:
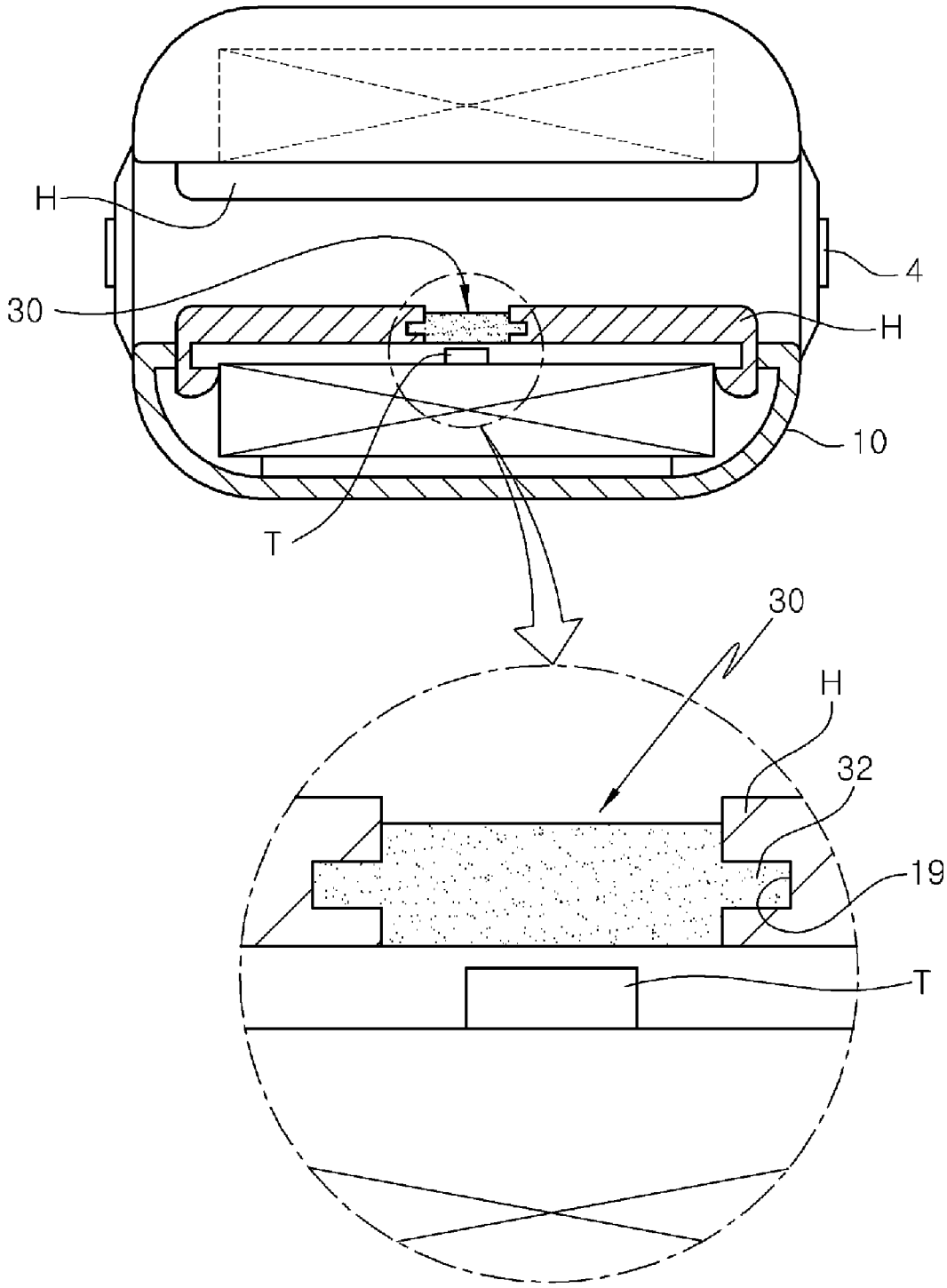
FIG. 6 is a section view taken along line B-B in FIG. 4, illustrating the internal structure of the present hairdressing device.

Referring to FIGS. 4 through 6, there is shown a hairdressing device 1 in accordance with one embodiment of the present invention. As shown, the hairdressing device 1 includes a pair of arm members 12 each having a hinge portion 6, a grip portion 8 and a hair-pinching portion 10. The hinge portions 6 of the arm members 12 are joined by a hinge pin 4.

Just like typical clamps, the arm members 12 can be swung about the hinge pin 4 away from or toward each other. A biasing member (not shown) is retained between the hinge portions 6 to resiliently bias the arm members 12 away from each other. This enables a user to hold the hair with the hairdressing device.

The grip portions 8 of the arm members 12 are contiguous to the hinge portions 6 and are designed to be gripped by a user with ease during the course of performing a permanent. A digital display unit 14 for indicating information such as a heating temperature and a permanent completion time is arranged in one of the grip portions 8. Also arranged in one of the grip portions 8 is a power button 16 for, when actuated, allowing electric power to be applied to the hairdressing device.

The hair-pinching portions 10 of the arm members 12 are contiguous to the grip portions 8 and are designed to pinch the hair therebetween. The hair-pinching portions 10 are provided with heater members 18 facing to each other.

Each of the heater members 18 includes a pair of heating plates H attached to the corresponding one of the hair-pinching portions 10. The heating plates H are arranged side by side in a spaced-apart relationship with each other. Alternatively, it may be possible to employ a single heating plate in place of the pair of heating plates H. The heating plates H are formed of ceramic heaters.

A heat-resistant transparent member 30 for allowing light to pass therethrough is arranged between the heating plates H. As can be seen in FIGS. 5 and 6, the heat-resistant transparent member 30 has protrusion portions 32 formed on the opposite side surfaces thereof. Each of the heating plates H has a slide groove 19 into which each of the protrusion portions 32 of the heat-resistant transparent member 30 is slidingly fitted. In addition, the heat-resistant transparent member 30 has a light transmission portion 34 extending in the longitudinal direction thereof.

A plurality of infrared generators T for generating infrared rays is provided within one of the hair-pinching portions 10. The heat-resistant transparent member 30 is placed above the infrared generators T. The infrared rays generated by the infrared generators T are uniformly projected toward the hair through the heat-resistant transparent member 30.

The heat-resistant transparent member 30 is made of monocrystalline heat-resistant glass that can bear the heat of about 1000° C. This ensures that the heat-resistant transparent member 30 is kept rigid without suffering from deformation even when the heater members 18 come into a high temperature state. The heat-resistant transparent member 30 is capable of transmitting the infrared rays generated by the infrared generators T.

The heat-resistant transparent member 30 is formed to have the same size as that of the heating plates H of the heater members 18. This makes it possible to increase the light transmission area as compared with the prior art. In other words, employment of the heat-resistant transparent member 30 makes it possible to use the light transmission portion 34 as an infrared transmission path, which assists in enhancing the transmission efficiency of infrared rays.

Use of the heat-resistant transparent member 30 prevents water vapor generated during permanent from infiltrating into the hair-pinching portions 10. This assists in preventing occurrence of trouble in the hairdressing device and prolonging the lifespan thereof.

In the conventional hairdressing device, there is a need to form a plurality of far infrared emission holes in a metallic support member so that the far infrared rays can pass through the support member.

According to the present hairdressing device, however, the infrared rays can pass the heat-resistant transparent member 30. This eliminates the need to form the infrared emission holes in the heat-resistant transparent member 30, thereby making it possible to sharply reduce the production cost.

Next, description will be made on the operation of the present hairdressing device.

The power switch 16 is turned on to apply electric power to the hairdressing device 1, and the digital display unit 14 is manipulated so that the infrared generators T can generate infrared rays. Then, the hair is gripped by the hair-pinching portions 10.

In response, the infrared generators T are operated to generate infrared rays in the hair-pinching portions 10. The infrared rays thus generated are projected to the outside through the heat-resistant transparent member 30 arranged between the heating plates H of the heater members 18. At this time, the infrared rays pass through the entire region of the light transmission portion 34 and are projected toward the hair, thus preventing occurrence of damage in the hair.

During this permanent process, the hair is wet with a permanent solution. Water vapor is generated when the hair makes contact with the heater members 18 kept at a high temperature. Since the heat-resistant transparent member 30 has no hole, the water vapor is prevented from infiltrating into the hair-pinching portions 10. As a result, the component parts arranged within the hair-pinching portions 10 are protected from the water vapor generated in the permanent process. This assists in preventing occurrence of trouble in the hairdressing device 1 and prolonging the lifespan thereof.

With the present hairdressing device described above, the infrared rays are uniformly projected toward the hair through the heat-resistant transparent member 30 in the permanent process. This helps prevent the hair from being damaged, which assists in keeping the hair glossy and demonstrating different hair styles.

While one preferred embodiment of the invention has been described hereinabove, the present invention shall not be limited thereto. It should be understood that various changes and modifications may be made without departing from the scope of the invention defined in the claims.

What is claimed is:

1. A hairdressing device comprising:

a pair of arm members opposed to each other and hingedly connected at one longitudinal ends thereof, each of the arm members including a hinge portion, a grip portion contiguous to the hinge portion and a hair-pinching portion contiguous to the grip portion; and a heater member arranged in the hair-pinching portion of each of the arm members to generate heat when supplied with electric power, the heater member including a pair of heating plates arranged side by side in a spaced-apart relationship with each other, and a plurality of infrared generators arranged between the pair of heating plates to generate infrared rays, wherein the heater member includes a heat-resistant transparent member arranged between the heating plates and above the plurality of infrared generators to transmit infrared rays.

2. The hairdressing device as recited in claim 1, wherein each of the heating plates has a slide groove formed on one side surface thereof, and wherein the heat-resistant transparent member has a light transmission portion through which infrared rays can pass and protrusion portions formed on the opposite side surfaces of the light transmission portion, the protrusion portions being slidingly fitted to the slide grooves of the heating plates.

3. The hairdressing device as recited in claim 1, wherein the heat-resistant transparent member is made of monocrystalline heat-resistant glass that can bear the heat of about 1000° C.

* * * * *